US009458741B2

(12) United States Patent
Mistry

(10) Patent No.: US 9,458,741 B2
(45) Date of Patent: Oct. 4, 2016

(54) SPLIT CYCLE PHASE VARIABLE RECIPROCATING PISTON SPARK IGNITION ENGINE

(75) Inventor: Jiban Jyoti Mistry, Malda (IN)

(73) Assignees: Chandan Kumar Seth, Malda (IN); Jiban Jyoti Mistry, Malda (IN)

( * ) Notice: Subject to any disclaimer, the term of this patent is extended or adjusted under 35 U.S.C. 154(b) by 0 days.

(21) Appl. No.: 14/112,701

(22) PCT Filed: Apr. 16, 2012

(86) PCT No.: PCT/IN2012/000268

§ 371 (c)(1),
(2), (4) Date: Dec. 13, 2013

(87) PCT Pub. No.: WO2012/143940

PCT Pub. Date: Oct. 26, 2012

(65) Prior Publication Data

US 2014/0090615 A1 Apr. 3, 2014

(30) Foreign Application Priority Data

Apr. 19, 2011 (IN) ..... 553/KOL/2011

(51) Int. Cl.
*F01L 1/34* (2006.01)
*F01L 1/344* (2006.01)
(Continued)

(52) U.S. Cl.
CPC ..... *F01L 1/344* (2013.01); *F02B 33/22* (2013.01); *F02B 39/04* (2013.01); *F02B 75/042* (2013.01);
(Continued)

(58) Field of Classification Search
CPC ..... F01L 1/3442; F01L 1/34; F01L 1/022; F01L 2001/34426; F01L 1/344
USPC ..... 123/90.17
See application file for complete search history.

(56) References Cited

U.S. PATENT DOCUMENTS 4,170,970 A * 10/1979 McCandless ..... 123/52.4
6,619,267 B1 9/2003 Pao
(Continued)

FOREIGN PATENT DOCUMENTS

JP 55146231 A 11/1980
JP 62225720 A 10/1987
WO WO 2008122992 A1 * 10/2008

OTHER PUBLICATIONS

Leduc et al., Downsizing of Gasoline Engine: an Efficient Way to Reduce CO2 Emissions, Oil & Gas Science and Technology—Rev IFP, 2003, pp. 115-127, vol. 58, No. 1.
(Continued)

*Primary Examiner* — Lindsay Low
*Assistant Examiner* — Charles Brauch
(74) *Attorney, Agent, or Firm* — Harness, Dickey & Pierce

(57) ABSTRACT

A split cycle phase variable reciprocating piston spark ignition engine comprising a compressor unit having a compression chamber adapted to carry out the intake and compression strokes of a four stroke engine cycle, a power unit having an expansion chamber adapted to carry out the expansion and exhaust strokes of a four stroke engine cycle, a crossover gas passage for transferring compressed gas from the compression chamber to the expansion chamber, an expansion chamber volume modifier to provide nearly full load like combustion chamber condition at all the engine load conditions by means of modifying volume and shape of the expansion chamber, a phase altering mechanism for altering phase relation between the compressor unit and the power unit as a function of engine load variation, an electronic control unit for providing control commands for various electrically operated actuators and motors.

6 Claims, 6 Drawing Sheets

(51) Int. Cl.

| | |
|---|---|
| ***F02B 33/22*** | (2006.01) |
| ***F02B 39/04*** | (2006.01) |
| ***F02B 75/04*** | (2006.01) |
| ***F02D 15/04*** | (2006.01) |
| *F01L 1/02* | (2006.01) |

(52) U.S. Cl.
CPC ..... *F02D 15/04* (2013.01); *F01L 1/022* (2013.01); *F01L 1/34* (2013.01); *F01L 1/3442* (2013.01); *F01L 2001/34426* (2013.01)

(56) References Cited

U.S. PATENT DOCUMENTS

| | | | | |
|---|---|---|---|---|
| 6,640,543 | B1 | 11/2003 | Seal | |
| 7,353,786 | B2 | 4/2008 | Scuderi et al. | |
| 7,628,126 | B2 | 12/2009 | Scuderi | |
| 8,156,904 | B2 * | 4/2012 | Giannini et al. | 123/53.5 |
| 2008/0053303 | A1 | 3/2008 | Crower et al. | |

OTHER PUBLICATIONS

Roberts, Benefits and Challenges of Variable Compression Ratio (VCR), Society of Automotive Engineers Paper No. 03P-227, 2002, 11 pages.

Shiga et al. Effect of Over-expansion Cycle in a Spark-ignition Engine Using Late-closing of Intake Valve and its Thermodynamic Consideration of the Mechanism, International Journal of Automotive Technology, 2001, pp. 1-7, vol. 2, No. 1.

* cited by examiner

SPLIT CYCLE PHASE VARIABLE RECIPROCATING PISTON SPARK IGNITION ENGINE

CROSS-REFERENCE TO RELATED APPLICATIONS

This application is the United States national phase of International Application No. PCT/IN2012/000268 filed Apr. 16, 2012, and claims priority to Indian Patent Application No. 553/KOL/2011 filed Apr. 19, 2011, the disclosures of which are hereby incorporated in their entirety by reference.

TECHNICAL FIELD OF THE INVENTION

The present invention relates to four stroke cycle internal combustion spark ignition engine and more specifically to a split four stroke cycle spark ignition reciprocating piston engine having at least a pair of piston-crankshaft assembly in which one piston-crankshaft assembly is used for the intake and compression strokes and another piston-crankshaft assembly is used for the power and exhaust strokes, wherein the crankshafts of both the piston-crankshaft assemblies are operatively interconnected by a phase altering mechanism that provide variability in the phase relation between the above mentioned piston-crankshaft assemblies.

BACKGROUND OF THE INVENTION

Traditional four-stroke cycle engines are configured with one or more cylinders wherein each one of the cylinders goes through all the four strokes (intake, compression, combustion and exhaust) of a thermodynamic cycle. This basic century old arrangement is still used in a modern vehicle because of its simple construction and efficiency to produce power that causes a vehicle move. But in present day's scenario wherein the ever depleting petroleum resources and alarmingly increasing CO2 in global atmosphere insists the scientists to rethink on the traditional energy conversion technologies, the Internal combustion (IC) engines need to be more fuel efficient and less environment hazardous. In spark ignition (SI) engine, there are various practical constraints in the traditional engine design that produces poor overall thermodynamic efficiency, especially at regular drive conditions of a vehicle. Because the SI engine load control is essentially done by quantitative control in induction of combustible mixture, the regular drive condition or low engine load condition in a SI engine suffers from various problems like: 1) considerable charge dilution and increase in induction fluid temperature by residual burnt gas wherein, higher induction temperature limits compression ability of the working fluid, 2) low initial and peak combustion chamber pressure, 3) slow flame propagation in combustion chamber, 4) incomplete combustion and 5) pumping loss.

The basic components of an internal combustion engine are well known in the art and include the engine block, cylinder head, cylinders, pistons, valves, camshaft and crankshaft. The cylinders, cylinder heads and tops of the pistons typically form working chambers into which fuel and air is introduced and combustion takes place. The volumes of the working chambers or chamber volumes repetitively expand and contract with the back-and-forth motion of the pistons. In a four-stroke cycle engine, power is recovered from the combustion process in four separate piston strokes of a single piston. The piston is so connected to a crankshaft by a connecting rod that the back-and-forth motion of the piston can be translated into rotary motion of the crankshaft. A stroke is defined as a complete movement of a piston from a top dead center (TDC) position to a bottom dead center (BDC) position or vice versa. The strokes are referred to as intake stroke, compression stroke, combustion or expansion stroke and exhaust stroke. Wherein, only the expansion stroke is the power delivering stroke that causes a vehicle move. All the remaining strokes are power consuming strokes. When the piston reaches to the top dead center (TDC) position the chamber volume contracts to its minimum value and at the bottom dead center (BDC) position of the piston the chamber volume expands to its maximum value. The minimum chamber volume also referred to as the clearance volume. Ratio of the maximum and minimum chamber volumes represents the engine's compression ratio which is fixed for a conventional engine. The efficiency of an SI engine substantially relies on its compression ratio that means higher the compression ratio, higher the engine's thermodynamic efficiency. Higher compression ratio produces higher combustion chamber pressure and temperature and thereby results in more heat conversion to useful work. Though, beyond certain restriction point the compression ratio induces knocking which is detrimental to the engine. Knocking means a high pressure wave generated by uncontrolled combustion in SI engine's combustion chamber and this phenomenon greatly rely on the initial combustion chamber temperature, pressure and compression ratio of the working volume. Therefore, the compression ratio of an SI engine is determined by considering this knocking point.

The load control of a spark ignition (SI) engine is done by controlling the induction of fuel-air mixture quantitatively. Therefore, at common drive condition, SI engine cylinders are charged with only a fraction of air-fuel mixture than that of its optimum capacity. The quantitative control of fuel-air mixture is done by throttling the intake passage, therefore the pressure in the intake passage drops significantly below the atmospheric pressure and the piston has to do some additional work in intake stroke which is generally known as pumping loss. As a result, the initial and final combustion chamber pressure drops drastically and this phenomenon affects the cycle thermodynamic efficiency. At the end of every thermodynamic cycle, some nearly constant amount of burnt gas residues remain in the clearance volume of the cylinders and in the next cycle this inert residual gas mixes with fresh intake gases and makes it diluted. At ordinary drive condition this residual gas proportion is substantially higher than it is at heavy load drive condition; hence the charge become considerably diluted and this reduces the flame speed in working fluid and results in poor combustion quality. Dilution also increases the chances to misfire and so fuel enrichment is needed.

Traditional SI engines intake and compress a mixture of fuel and air. The ratio of specific heat ($\gamma$) of fuel-air mixture is considerably less than that of only air. It is evident to those familiar in the internal combustion engine thermodynamics that the working fluid with higher ratio of specific heat produces higher cycle efficiency. This is one of the reasons behind the greater efficiency of Compression Ignition (CI) engine over Spark Ignition (SI) engine. Some modern engine manufacturers using Gasoline Direct Injection (GDI) technology wherein, at low-load drive conditions GDI technology uses only air as intake fluid and fuel is injected at the later stage of compression phase. GDI technology also uses stratified charging method that forms fuel rich mixture at sparkplug vicinity and fuel lean mixture at rest of the area, wherein maintaining the overall mixture fuel lean. The ratio of specific heats of fuel lean mixture is higher than stoichiometric (chemically correct) mixture, hence, produce greater thermodynamic efficiency. Moreover, at regular drive conditions GDI can reduce the need of throttling and thereby the pumping loss also. But, fuel lean combustion deteriorates the performance of Three-way Catalytic Converter (TWC). GDI also needs costly fuel injectors and precise control system.

It is known that a spark ignition (SI) internal combustion (IC) engine is generally most efficient when the cylinder pressure and temperature at the end of a compression phase are closed to its maximum tolerable limit. In a conventional spark ignition engine, this condition is achievable only when the throttle valve in the intake manifold is fully open to allow the maximum possible air or fuel-air mixture in the engine cylinder during intake phase and during following compression phase said intake air get compressed into a minimum chamber volume which is fixed by the design of the engine. During fully-open throttle condition the intake manifold pressure is near atmospheric pressure or about 1 bar. During the typical driving conditions which generally cover above 90% of the entire drive cycle, the intake manifold pressure remains about 0.5 bar or less, causing considerable drag on the driveshaft and this phenomenon is commonly known as 'pumping loss', that adversely affects the engine efficiency. Throttling further reduces chamber pressure and temperature at the end of compression phase and increase charge dilution. Hence reduces the combustion flame speed and the engine suffers from unstable combustion which leads to reduction in efficiency and increase in hazardous tailpipe emissions.

Conventionally, a mid-size car with a gasoline engine is only about 20% efficient when cruising on a level road whereas the rated peak efficiency of the car is about 33%. That is, during cruising, the Specific Fuel Consumption (SFC) of the engine is about 400 g/kWh, while under high load condition the same engine can reach a SFC of 255 g/kWh. See, P. Leduc, B. Dubar, A. Ranini and G. Monnier, "Downsizing of Gasoline Engine: an Efficient Way to Reduce $CO_2$ Emissions", Oil & Gas Science and Technology—Rev. IFP, Vol. 58 (2003), No. 1, pp. 117-118. As the engine operating condition goes below cruising mode such as the city driving conditions, the efficiency further reduces drastically. Considering this, if an engine is so downsized to operate with higher specific load during cruising or city driving condition, it could not accelerate or climb steep road well.

In the past decades some interesting ideas like Variable Displacement Technology, Variable Compression Ratio Technology, Variable Valve Technology, Engine Downsizing and Pressure Boosting, Stratified Charging of Fuel, Controlled Auto Ignition, Load Dependant Octane Enhancement of Fuel have been introduced in order to attain better SI engine efficiency and various sets of combinations of these methods have also been experimented within a single engine.

In reciprocating piston Spark ignition engine, the Variable Displacement volume of engine is generally achieved by cylinder deactivation method, wherein, during part load operation, few cylinders of a multi-cylinder engine are selectively deactivated so that not to contribute to the power and thus reducing the active displacement of the engine. Therefore, only the active cylinders consume fuel and are operated under higher specific load than that of the all cylinder operations, hence the engine attains higher fuel efficiency. The number of deactivated cylinders can be chosen in order to match the engine load, which is often referred to as "displacement on demand". As pistons of both of the active and deactivated cylinders are generally connected to a common crankshaft, the deactivated pistons continue to reciprocate within the respective cylinders resulting in undesired friction. The valves of the deactivated cylinders need specialized controls, which produce further complications. Moreover, the deactivation and reactivation of cylinders take place in steps, and therefore further measures become necessary in order to make the stepped transitions smooth. Managing unbalanced cooling and vibration of variable-displacement engines are other designing challenges for this method. In most instances, cylinder deactivation is applied to relatively large displacement engines that are particularly inefficient at light load. Modern electronic engine control systems are configured to electronically control various components such as throttle valves, spark timing, intake-exhaust valves etc. in order to smoothing of the transition steps of a variable displacement IC engine. An example of electronic throttle control method is to be found in U.S. Pat. No. 6,619,267 (Pao), describing the intake flow control scheme to manage the transition steps. A variable displacement system for both the reciprocating piston and rotary IC engines is disclosed in U.S. Pat. No. 6,640,543 (Seal) that includes a turbocharger to enhance the working efficiency.

Like variable displacement engine technologies, the variable compression ratio (VCR) technologies also require various associated modifications such as engine downsizing, turbocharging or supercharging, variable valve technology, load responsive octane enhancement of fuel etc. to meet increasing stringent emission norms and fuel efficiency requirements. The basic VCR idea is to run an engine at higher compression ratio under part load operating conditions when a fraction of full intake capacity is consumed and at relatively lower compression ratio under heavy load conditions when the full intake capacity is consumed. Thereby the resultant cylinder pressure and temperature at the end of compression can be improved through a wide load conditions, hence, better fuel efficiency could be achieved. As VCR technology alone cannot avoid part load pumping losses, it requires assistance of Variable Valve Technology (VVT). The VVT provides the benefit of un-throttled intake to an SI engine, wherein the amount of intake gas at part load is controlled by either closing the intake valve early to stop excess intake or by late intake valve closing so that to discharge excess intake gas back to the intake manifold. The VCR technology itself, however, is quite complex to design and manufacture. See "Benefits and Challenges of Variable Compression Ratio (VCR)", Martyn Roberts, SAE Technical Paper No. 2003-01-0398.

Over expansion cycle in a SI engine can add significant benefit to its thermal efficiency. The Atkinson cycle and Miller cycle efficiency is established on the said over expansion cycle principle, see "Effect of over-expansion cycle in a spark-ignition engine using late-closing of intake valve and its thermodynamic consideration of the mechanism", S. Shiga, Y. Hirooka, Y. Miyashita, S. Yagi, H. T. C. Machacon, T. Karasawa and H. Nakamura, International Journal of Automotive Technology, Vol. 2, No. 1, pp. 1-7 (2001). The over-expansion cycle can produce substantial benefit in thermal efficiency over conventional engine cycle when being applied together with variable compression ratio and variable valve technology. But the introduction difficulties remain too high to introduce in a practicable engine.

Various specialized prior art engines have been designed in an attempt to increase engine efficiency. By way of example, a recent prior art engine is described in U.S. Pat. No. 7,628,126 to Carmelo J. Scuderi entitled "Split four stroke engine". In this engine, a crankshaft rotating about a crankshaft axis of the engine. A power piston is slidably received within a first cylinder and operatively connected to the crankshaft such that the power piston reciprocates through a power stroke and an exhaust stroke of a four stroke cycle during a single rotation of the crankshaft. A compression piston is slidably received within a second cylinder and operatively connected to the crankshaft such, that the compression piston reciprocates through an intake stroke and a compression stroke of the same four stroke cycle during the same rotation of the crankshaft. A gas passage interconnects the first and second cylinders. The gas passage includes an inlet valve and an outlet valve defining a pressure chamber therebetween. The outlet valve permits substantially one-way flow of compressed gas from the pressure chamber to the first cylinder. Combustion is initiated in the first cylinder between 0 degrees and 40 degrees of rotation of the crankshaft after the power piston has reached its top dead center position.

In this engine, at the end of a compression stroke, the combustion initiates in the first cylinder and being connected with the same crankshaft, the phase relation of the power and compression piston is fixed. Therefore, at the point of ignition the combustion chamber volume is fixed for all load conditions and this should essentially be optimized for the full load driving condition. At typical drive conditions, when the engine consumes a fraction of its full intake capacity, the initial pressure and temperature of the expansion chamber should drop drastically. This phenomenon should affect the engine's part-load performance.

Another prior art engine is described in U.S. Pat. No. 7,353,786 to Salvatore C. Scuderi entitled "Split-cycle air hybrid engine". Various operating modes and alternative embodiments of the engine are described, in which at part load operating mode of the engine a fraction of total compressed air is used for combustion purpose and the rest is stored in a storage tank for future uses. The volume compression ratio of both the compression and power cylinders of this engine is very high (80 to 1 or more). Therefore, at part load mode when only a fraction of compressed gas is used for combustion, the combustion chamber shape at the time of ignition would be very thin if a favorable chamber pressure and temperature is maintained and this kind of chamber shape is highly unfavorable to carryout a desirable combustion. Moreover, it is very difficult to retain the temperature and pressure of compressed air stored in the storage tank and so using of the stored compressed air would be very difficult due to its continuously variable pressure-temperature parameters.

Accordingly, there is a need for an improved four-stroke spark ignition internal combustion engine, which is simple to manufacture and can maintain favorable combustion chamber conditions, e.g. suitable combustion chamber pressure, temperature, turbulence and chamber shape at all the driving conditions. The engine should be an over expansion cycle engine and capable to carryout such a charging method that enhance engine's thermodynamic efficiency.

OBJECT OF THE INVENTION

An object of the invention is the provision of a split cycle phase variable reciprocating piston spark ignition engine that offers substantially higher thermodynamic efficiency over the prior art by means of a four stroke internal combustion engine having at least a pair of piston, cylinder and crankshaft assembly, wherein the first assembly is a Compressor Unit that carry out only the intake and compression strokes and the second assembly is a Power Unit that carry out the expansion and exhaust strokes of a four stroke thermodynamic cycle. As the working fluid, the compressor unit uses only air and the ratio of specific heat ($\gamma$) of air is considerably higher than that of fuel-air mixture used as working fluid in compression strokes of conventional spark ignition (SI) engines. Hence, at the end of compression stroke, the split cycle phase variable reciprocating piston spark ignition engine achieve higher chamber pressure than that of conventional SI engine at equivalent compression ratio. The compressed air is delivered to the power unit through a crossover gas passage. Fuel is injected into the gas passage where it mixes with compressed air and the fuel-air mixture then delivered into the expansion chamber of the power unit where combustion is initiated by a sparkplug. Unlike conventional SI engines, the working chambers of the engine of the present invention retain virtually no residual burnt gas, therefore, able to produce higher charge density and initial expansion chamber pressure at lower chamber temperature. An expansion chamber volume modifier is introduced for modifying the expansion chamber volume and shape so that good combustion quality and virtually total expulsion of exhaust product may achieve.

Another object of the invention is the provision of a split cycle phase variable reciprocating piston spark ignition engine, wherein the crankshafts of the compressor unit and the power unit are operatively connected to each other by a phase altering mechanism that, being responsive to instantaneous load demand, can alter the phase relation between the crankshafts and thereby produce variability in phase relation between the compressor and the power unit, hence, can maintain optimum expansion chamber environment throughout the load conditions. This is advantageous over the prior art engine specially at most common part load drive conditions when only a fraction of full intake capacity is used as working fluid.

A further object of the present invention resides in the provision of a novel split cycle phase variable reciprocating piston spark ignition engine system including an un-throttled intake system for avoiding pumping loss. At low load operating conditions the intake chamber is allowed to intake full capacity of air and, in response to the instantaneous load condition, a measured amount of intake air is returned back from the compression chamber to the intake passage by means of keeping the intake valve open for a predetermined period during compression stroke. On the closing of said intake valve an effective compression of the remaining intake gases starts.

A further important object of the invention is the provision of a split cycle phase variable reciprocating piston spark ignition engine capable to carryout high over-expansion cycle at part load engine operating mode and thereby produce substantially higher thermodynamic efficiency over prior art engines.

A still further object of the invention is the provision of a split cycle phase variable reciprocating piston spark ignition engine, which is free from design complexity and is controllable by state of the art control methods.

DETAILED DESCRIPTION OF THE INVENTION

Figure 1:
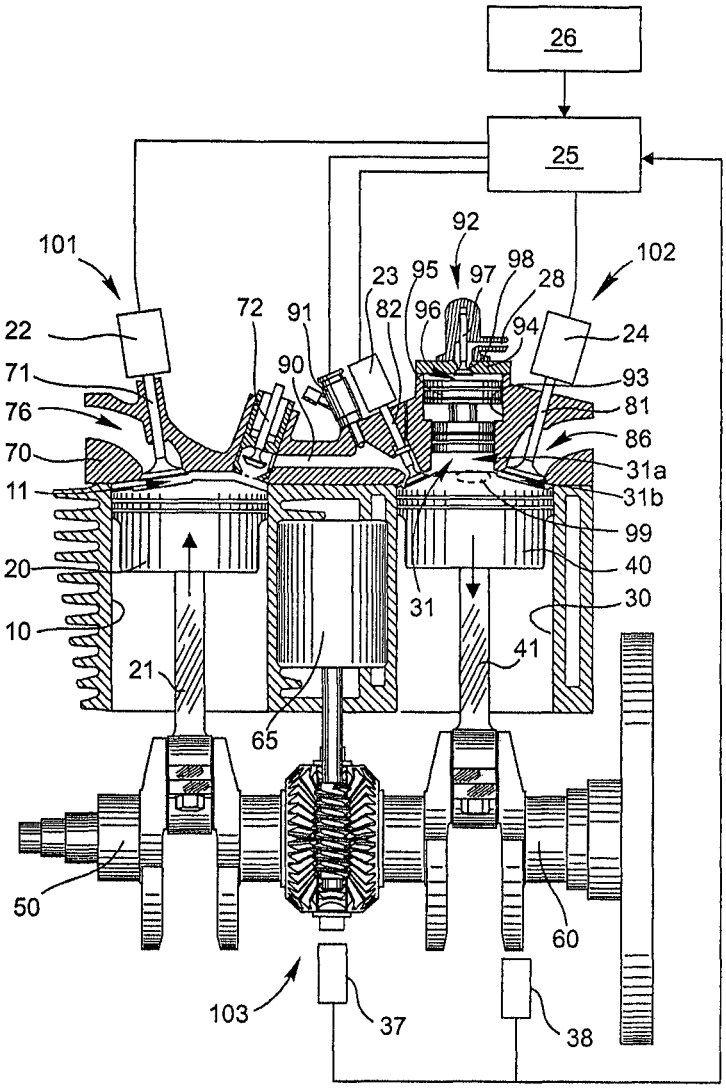
FIG. 1 is a schematic illustration of the basic arrangement of one embodiment of a split cycle phase variable reciprocating piston spark ignition engine of the present invention.

With reference first to FIG. 1, a split cycle phase variable reciprocating piston spark ignition engine including a first piston cylinder configuration 101 for carrying out the intake and compression strokes of a four stroke engine cycle and a second piston cylinder configuration 102 for carrying out the expansion and exhaust strokes of a four stroke engine cycle. The first piston cylinder configuration 101 may hereinafter be referred to as the Compressor Unit 101 and the second piston cylinder configuration 102 may hereinafter be referred to as the Power Unit 102. The Compressor Unit 101 comprises a cylinder 10 into which a piston 20 reciprocates within a distance determined by a first crankshaft 50 and the Power Unit 102 comprises a cylinder 30 into which a piston 40 reciprocates within a distance determined by a second crankshaft 60. A connecting rod 21 connects the piston 20 to the first crankshaft 50 and a connecting rod 41 connects the piston 40 to the second crankshaft 60. A cylinder head 70 is attached on the top of the cylinders 10 and 30. The cylinders 10 and 30, the cylinder head 70, pistons 20 and 40 typically form working chamber 11 and 31 respectively. The working chamber 11 may hereinafter be referred to as the compression chamber 11 and the working chamber 31 may hereinafter be referred to as the expansion chamber 31. The crankshaft 50 of compressor unit 101 and crankshaft 60 of power unit 102 are operatively interconnected there-between by a phase altering mechanism 103 that transmit power from the power unit 102 to the compressor unit 101, but more specifically, configured to alter the phase relation between the said compressor unit 101 and power unit 102 by means of changing the phase relation between crankshafts 50 and 60. The phase altering mechanism 103 including a motor 65 configured to alter the phase relation as a function of variation in engine loads. The cylinder head 70 comprises an intake port 76, an intake valve 71, one end of a crossover gas passage 90 including a one-way check valve 72 in close proximity of the compression chamber 11 of compressor unit 101 and an exhaust port 86, an exhaust valve 81, other end of the crossover gas passage 90 including a crossover delivery valve 82 in close proximity of the expansion chamber 31 of the power unit 102. The one-way check valve 72 and the crossover delivery valve 82 are fluidly connected there-between by the crossover gas passage 90 so as to deliver compressed gases from compressor unit 101 to power unit 102. The crossover gas passage 90, check valve 72 and the crossover delivery valve 82 forms a pressure chamber there between. The intake valve 71 and crossover delivery valve 82 preferably use variable valve timing technology. The crossover gas passage 90 is mounted with a fuel injector 91 for injecting calibrated amount of fuel into the crossover gas passage 90. The cylinder head 70 also comprises a means 92 for modifying the volume of the expansion chamber 31 of the power unit 102. The means 92 for modifying the volume of the expansion chamber is hereinafter be referred to as expansion chamber volume modifier 92 that comprises a cylinder 93, cylinder head 94 and a reciprocating piston 95 movable within the cylinder 93. The Piston 95 is a free piston having two working sides at its top and bottom end. The bottom side of the piston 95 is exposed to the expansion chamber 31. The top of the piston 95, the cylinder 93 and the cylinder head 94 defines a pressure chamber 96. The cylinder head 94 is provided with an intake port 98, gas passage 28 and an inlet check valve 97 to secure one way flow of pressurized exhaust gas into the pressure chamber 96. Pressurized exhaust gas is supplied to the pressure chamber 96 because, in case of any leakage from said pressure chamber 96 to the expansion chamber 31 it must not increase the percentage of oxygen in exhaust gas and thus secure optimum performance of a Three Way Catalytic Converter (TWC). An external pump, not shown, provides the pressurized gas to the pressure chamber 96 via gas passage 28. The gas pressure in the gas passage 28 is maintained within a predetermined value that is considerably higher than atmospheric pressure but substantially lower than the pressure of crossover gas passage 90. The piston 95 is movable within the cylinder 93 by means of instantaneous pressure differential between the pressure chamber 96 and the expansion chamber 31 connected respectively to the top and bottom sides of the free piston 95.

FIG. 1 further illustrates the basic operating mode of the engine wherein the piston 20 of the compressor unit 101 is ascending with a compression stroke and the piston 40 of the power unit 102 is initiating with an expansion stroke. At later stage of compression stroke, the elevating pressure of compression chamber 11 reach a pressure higher than the pressure of crossover passage 90 and consequently this pressure differential causes to push the check valve 72 back to its opening position and compressed air start transferring from the compression chamber 11 to the crossover passage 90 and almost simultaneously an actuator 23 opens the crossover delivery valve 82 for transferring the compressed gas from crossover passage 90 to expansion chamber 31. The pressure of compressed gas that delivered to expansion chamber 31 push the free piston 95 up until the pressure of expansion chamber 31 and pressure chamber 96 reaches to virtually equilibrium condition and thus an initial shape of expansion chamber 31 is formed. The expansion chamber 31 includes a first volume variable chamber 31*a* formed within the cylinder 93 by displacement of the free piston 95 and a second volume variable chamber 31*b* formed within expansion cylinder 30 by displacement of the expansion piston 40. At nearly the end of transmission of compressed gas from the compressor unit 101 to the power unit 102, combustion initiate by a sparkplug (not shown, only the position of the sparkplug is shown by dotted lined ellipse 99).

With further progress of expansion stroke after peak combustion pressure is attained, the expansion chamber pressure start decreasing below the pressure of pressure chamber 96 and consequently the pressure differential between the pressure chamber 96 and expansion chamber 31 cause the free piston 95 moving down towards its initial position. Accordingly, as the volume of the pressure chamber 96 expands, its pressure drops and as the pressure of the pressure chamber 96 drops below the pressure of gas passage 28, pressurized exhaust gas start entering the pressure chamber 96 until a predetermined minimum chamber pressure is restored. At the end of an exhaust stroke, piston 40 of the power unit 102 reaches its TDC position and the free piston 95 retains its initial position maintaining a minimum mechanically tolerable distance from the top of the piston 40, thereby, the expansion chamber volume 31 reduces to a nearly negligible volume and as a result, almost all the exhaust products are expelled from the expansion chamber.

Mechanical volume compression ratio of the split cycle phase variable reciprocating piston spark engine is very high (80:1 to 100:1), therefore, at TDC position of the pistons 20 and 40 the clearance volumes become very small and thin in shape. This is favorable for the compressor unit 101 in order to achieve optimum delivery capacity of compressed gas and also favorable for the power unit 102 in order to expel the exhaust products optimally during the exhaust stroke, but highly unfavorable to carry out following combustion event. The expansion chamber volume modifier 92 is provided to produce a compact shaped combustion chamber 31*a* to solve this problem. The combustible mixture is delivered to expansion chamber under very high pressure, producing vigorous turbulence in combustible fluid. This kind of turbulence promotes a very quick combustion, which may result undesired vibration due to very quick pressure hike in the combustion chamber. The expansion chamber volume modifier 92 provides an air spring by means of providing the pressure chamber 96 that helps dampen the combustion shock and vibration at the source and thus eliminates the necessity of a conventional vibration damper.

The valve actuation events of the intake valve 71, exhaust valve 81, crossover delivery valve 82 are preferably controlled by an electronic control unit 25, which includes a programmable digital computer. The operation of such an electronic control unit 25 is well known to those skilled in the art of electronic control systems. The electronic control unit 25 also controls the injection time and pulse width of the fuel injector 91. The angular position of crankshaft 60 is measured by a crankshaft position sensor 38. The crankshaft position sensor 38 communicates the angular positions of the crank shaft 60 to the electronic control unit 25, where an engine speed determination is made. An amount of phase shift between the compressor unit 101 and the power unit 102 is measured by a phase shift sensor 37. The phase shift sensor 37 communicates the angular position of the phase altering mechanism 103 to the electronic control unit 25, where determination of an amount of phase shift between the compressor unit 101 and the power unit 102 is made.

Additionally, the electronic control unit 25 is configured to monitor a plurality of engine related inputs 26 from a plurality of transduced sources such as intake mass airflow, intake manifold temperature, ambient air temperature and pressure, intake and exhaust oxygen percentage, spark timing, operator torque requests, cylinder pressure etc. The electronic control unit 25 includes a look-up table (not shown), wherein various control command values are calculated from the look-up table and on the basis of the values of plurality of engine related input 26. The electronic control unit 25 further provides control commands for a variety of electrically controlled engine components, like intake valve actuator 22, crossover delivery valve actuator 23, exhaust valve actuator 24, fuel injector 91, motor 65 of phase altering mechanism 103 as well as the performance of general diagnostic functions.

Figure 2:
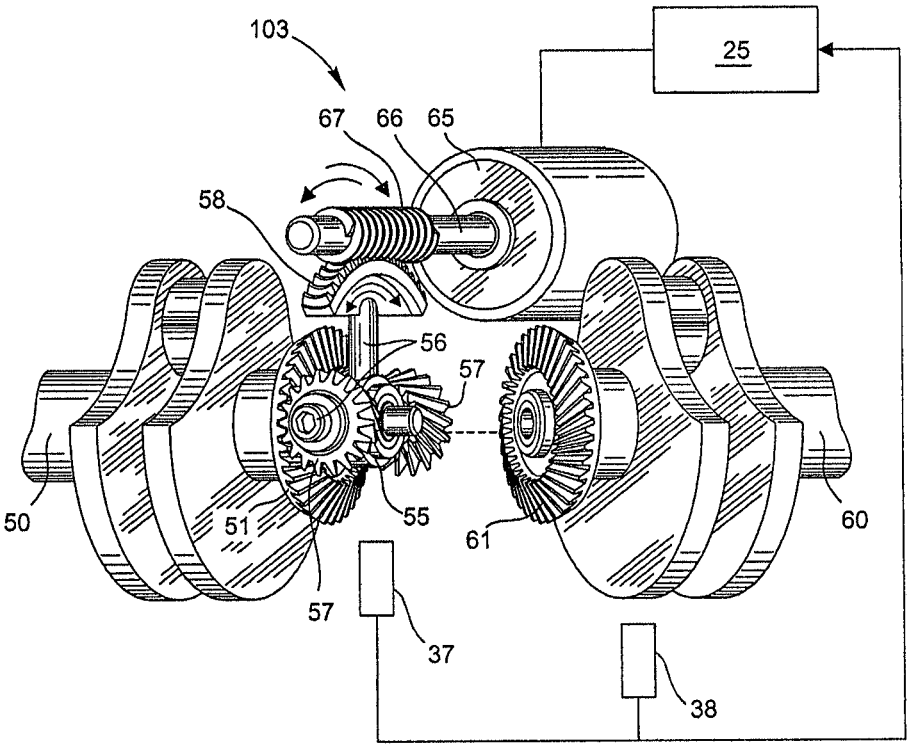
FIG. 2 is a schematic illustration of a phase altering mechanism, shown as partially dismantled, operable to alter phase relation between a compressor unit and a power unit as a function of engine load consistent with the present invention.

With reference to FIG. 2, the phase altering mechanism 103 includes a first bevel gear 51 and a second bevel gear 61 rigidly mounted on the facing ends of crankshafts 50 and 60 respectively. The crankshafts 50 and 60 are the part of and connected to the compressor unit 101 and the power unit 102 respectively. The bevel gears 51 and 61 are to be operatively connected (shown as dismantled here) there-between by an array of plurality of bevel gears 57 radially arranged on plurality of extended arms 56 of a spider hub 55. The spider hub 55 is coaxially supported on extended portion of either crankshaft 50 or crankshaft 60. Power is transmitted from the gear 61 to gear 51 via bevel gears 57. Thus, the bevel gear 61 is a drive gear and the bevel gear 51 is driven gear. Because of interconnecting gears 57, the rotation direction of the crankshafts 50 and 60 are essentially opposite to each other. The spider hub 55 is configured to provide controlled angular shift in either direction about its own axis and any angular displacement of the spider hub 55 produces a relative phase shift between crankshaft 50 and crankshaft 60. A worm gear 58 is rigidly attached with one of the extended arms 56 of the spider hub 55 in a coaxial manner with spider hub 55. A worm 67 is meshed with the worm gear 58. A shaft 66 connects the worm 67 to a motor 65 that drive the worm 67 through required rotations in either direction. The resultant phase shift angle between the crankshafts 50 and 60 would essentially be double to that of the angular shift of spider hub 55. The numbers and direction of rotation may preferably be determined by the electronic control unit 25. The phase shift sensor 37 communicates the angular position of the spider hub 55 of the phase altering mechanism 103 to the electronic control unit 25, where determination of phase shift between crankshafts 50 and crankshaft 60 is made.

Figure 3:
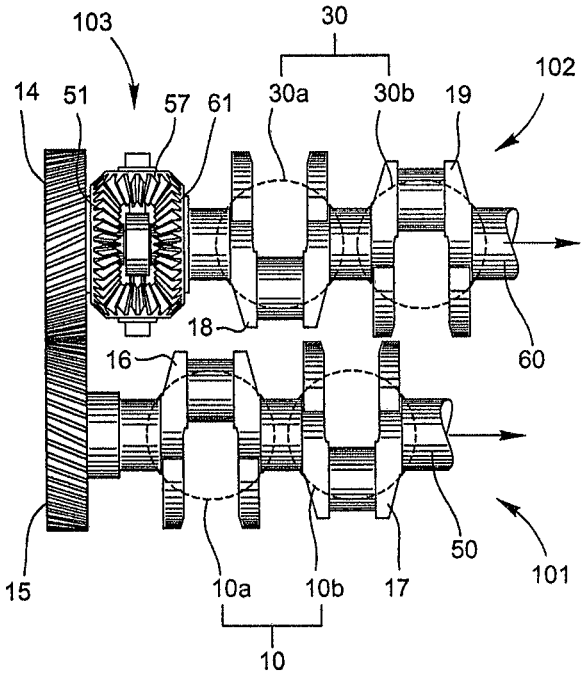
FIG. 3 is a schematic illustration of crankshafts arrangement for a multi cylinder arrangement of the engine of the present invention.

With reference to FIG. 3, a multi-cylinder configuration of the engine of the present invention comprising a multi-cylinder compressor unit 101, a multi-cylinder power unit 102, the phase altering mechanism 103, a pair of matching helical gears including a first helical gear 14 and a second helical gear 15. The multi-cylinder compressor unit 101 including a plurality of compression cylinders 10 and a crankshaft 50, and the multi-cylinder power unit 102 including a plurality of compression cylinders 30 and a crankshaft 60. The plurality of compression cylinders 10 including a first compression cylinder 10*a* and a second compression cylinder 10*b* and the plurality of expansion cylinders 30 including a first expansion cylinder 30*a* and a second expansion cylinder 30*b*. The crankshaft 50 of the compressor unit 101 including a plurality of crank throws, namely first crank throw 16 and the second crank throw 17 of the crankshaft 50. The crankshaft 60 of the power unit 102 including a plurality of crank throws namely first crank throw 18 and second crank throw 19 of the crankshaft 60. The crankshaft 50 is arranged in parallel axis with the crankshaft 60. The first crank throw 16 and the second crank throw 17 of the crankshaft 50 is configured to connect with the first compression cylinder 10*a* and second compression cylinder 10*b* respectively (shown schematically by dotted circles) and the first crank throw 18 and the second crank throw 19 of the crankshaft 60 is configured to connect with the first expansion cylinder 30*a* and second expansion cylinder 30*b*, respectively. The first compression cylinder 10*a* is fluidly connected to the first expansion cylinder 30*a* and similarly the second compression cylinder 10*b* is fluidly connected to the second expansion cylinder 30*b*. The phase altering mechanism 103 (shown partially) is coaxially incorporated to the crankshaft 60 of the power unit 102. The first helical gear 14 is coaxially connected to the crankshaft 60 via the phase altering mechanism 103, wherein, the first helical gear 14 is rigidly attached to the first bevel gear 51 of the phase altering mechanism 103 and the second bevel gear 61 of the phase altering mechanism 103 is rigidly attached to the crankshaft 60. The plurality of bevel gears 57 interconnects the bevel gears 51 and 61. The second helical gear 15 is connected to the crankshaft 50, wherein, the first and second helical gears 14 and 15 are operatively connected to each other. Being interconnected by the phase altering mechanism 103, the helical gear 14 and the crankshaft 60 are rotatable in opposite direction. The crankshaft 60 and the crankshaft 50 are rotatable in the same direction. It would be apparent from the above description and associated drawings that the engine of the present invention may be configured with more even numbered cylinders than that is described herewith.

Figure 4:
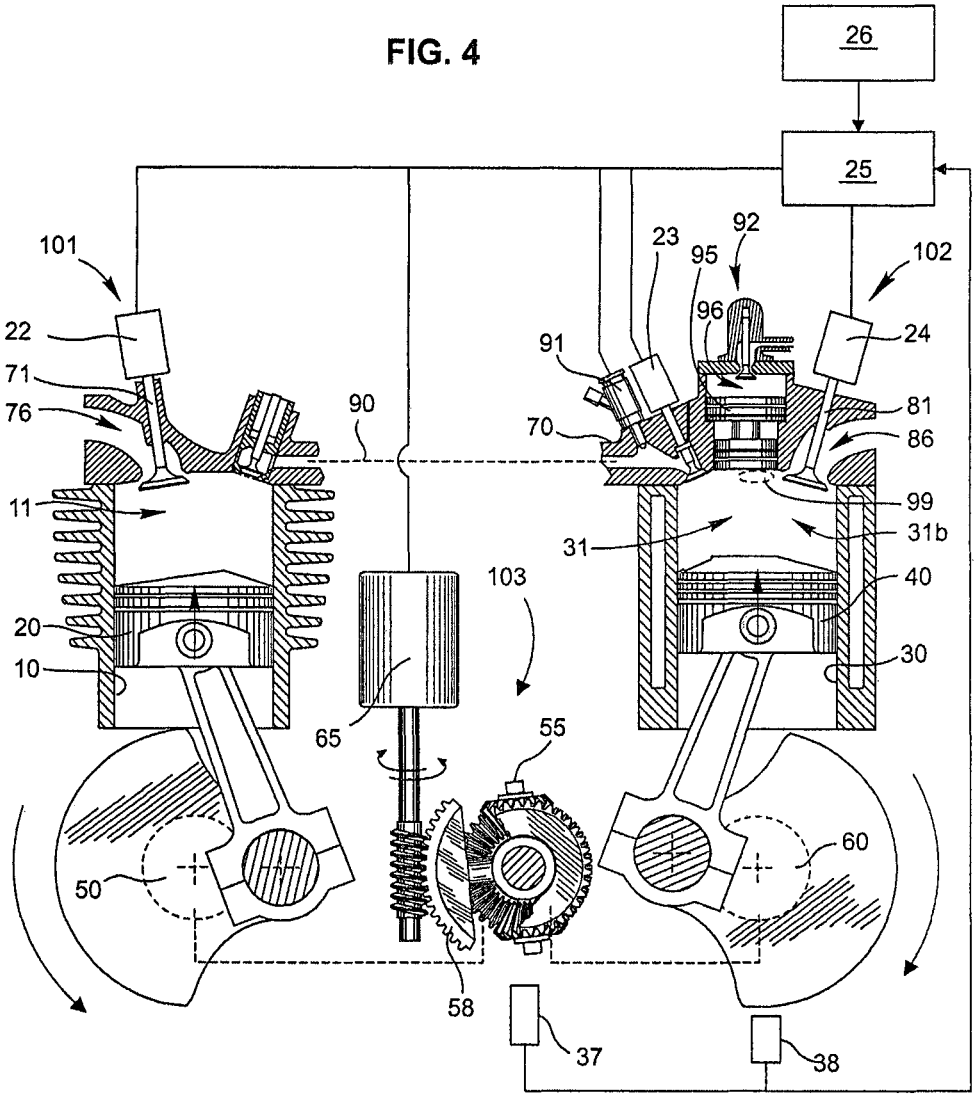
FIG. 4 is a partially dismantled view of the engine, schematically illustrates the altering relation between key components of the engine as a function of engine load consistent with the present invention.

With reference to FIG. 4, being responsive to commands by the electronic control unit 25, the motor 65 drives the worm gear 58 so as to produce a angular shift of the spider hub 55 through a predetermined angle so that the crankshaft 50 of the compressor unit 101 gets retarded by about 10 degrees out of phase to that of the crankshaft 60 of the power unit 102 in order to establish a low load operating condition of the engine of the present invention. The electronic control unit 25 receives communications from the phase shift sensor 37 about the instantaneous phase relation between the compressor unit 101 and the power unit 102, engine speed from crankshaft position sensor 38, operator's torque request and other relevant inputs from the inputs 26 and in accordance with the look-up tables calculates a position values for the spider hub 55, an angular displacement values for the motor 65 as well as it provides a valve actuation values for the intake valve actuator 22, crossover delivery valve actuator 23 and exhaust valve actuator 24. The electronic control unit 25 also calculates the injection time and pulse width for fuel injector 91 and ignition time for the sparkplug.

The piston 20 of the compressor unit 101 is ascending through a compression stroke and the piston 40 of the power unit 102 is ascending through an exhaust stroke, wherein, the piston 20 is retarded by 10 crank angle degree (CAD) than that of the piston 40. The exhaust valve 81 is opened to allow the exhaust gas to escape from expansion chamber 31 of power unit 102. The gas pressure of pressure chamber 96 is substantially higher than the pressure of the expansion cylinder 31 and this pressure differential retains the free piston 95 to its bottom position. Therefore, the chamber volume 31 become equivalent to the chamber volume 31*b*. The piston 20 has moved halfway through the compression stroke and the intake valve 71 is still open in order to allow a back flow of the intake air to the intake port 76. As the measured amount of intake air is secured in the compression chamber 11 the intake valve 71 returns to its close position and an effective compression of intake air starts. The intake valve actuator 22 is responsive to commands of the engine control unit 25. The intake valve 71 uses variable valve timing technology.

Figure 5:
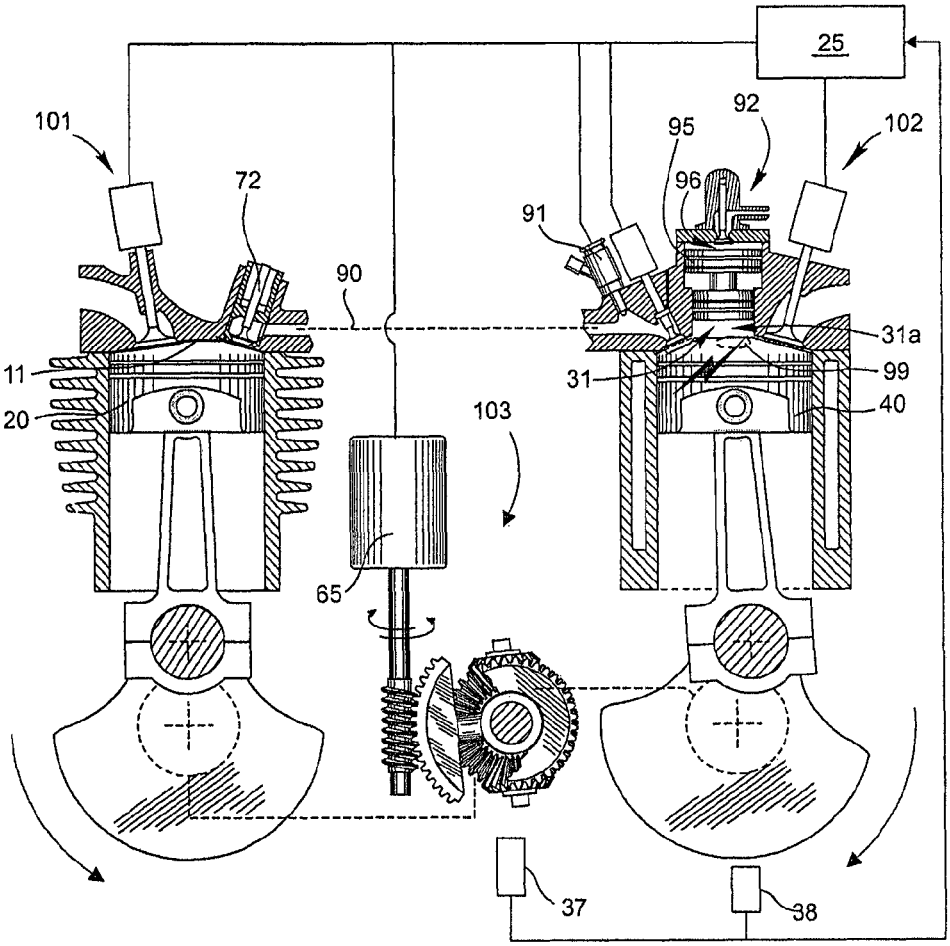
FIG. 5 is a partially dismantled view of the engine schematically illustrates the functionality of the engine at low load engine operating condition.

With reference to FIG. 5, at the end of a compression stroke as illustrated in FIG. 4, wherein a fraction of intake mass is compressed, the compression piston 20 reaches to its top dead center (TDC) position and the power piston 40 moved 10 crank angle degrees (CAD) past TDC position through an expansion stroke. The compressed air is delivered to crossover gas passage 90, which replaces the previously trapped compressed gas from said gas passage 90 to the expansion chamber 31 of the power unit 102. Fuel is injected in the crossover gas passage 90, where it mixes with the compressed air and then the air fuel mixture is transferred to said expansion chamber 31. Fuel injector 91 injects fuel into the crossover passage 90 just before and/or during transferring of compressed gas from the crossover gas passage 90 to the expansion chamber 31. The free piston 95 of the combustion chamber volume modifier 92 is pushed back by the pressure of combustible fluid and the combustion chamber 31 is formed, wherein, the volume of combustion chamber 31 is substantially defined by the expansion chamber 31*a*. Combustion is initiated at this position by a sparkplug (not shown) mounted on the spark plug hole 99.

Because, presence of hot residual burnt gas is negligible in expansion chamber, the initial pressure-temperature ratio of the expansion chamber 31 is substantially higher than the conventional SI engines. Unlike conventional SI engines, during a low load combustion event, the volume expansion rate of the expansion chamber 31 is very high and thus, a significant amount of heat energy gets converted into useful work. Hence, despite of a very quick combustion of the mixture, the cylinder temperature does not exceed a safe limit.

At low load operating condition, the modified expansion ratio of the expansion chamber is preferably configured between 20:1 and 25:1. An overexpansion cycle is capable to add a significant benefit to fuel efficiency of the engine. Though, at the later stage of expansion stroke, the above mentioned expansion ratio (20:1 to 25:1) may result in a pressure drop below atmospheric pressure and produces some negative work. Therefore, an early opening of exhaust valve is configured for low load operation of the engine so as to allow an exhaust backflow into the expansion chamber to prevent the sub-atmospheric pressure drop in expansion chamber 31.

Figure 6:
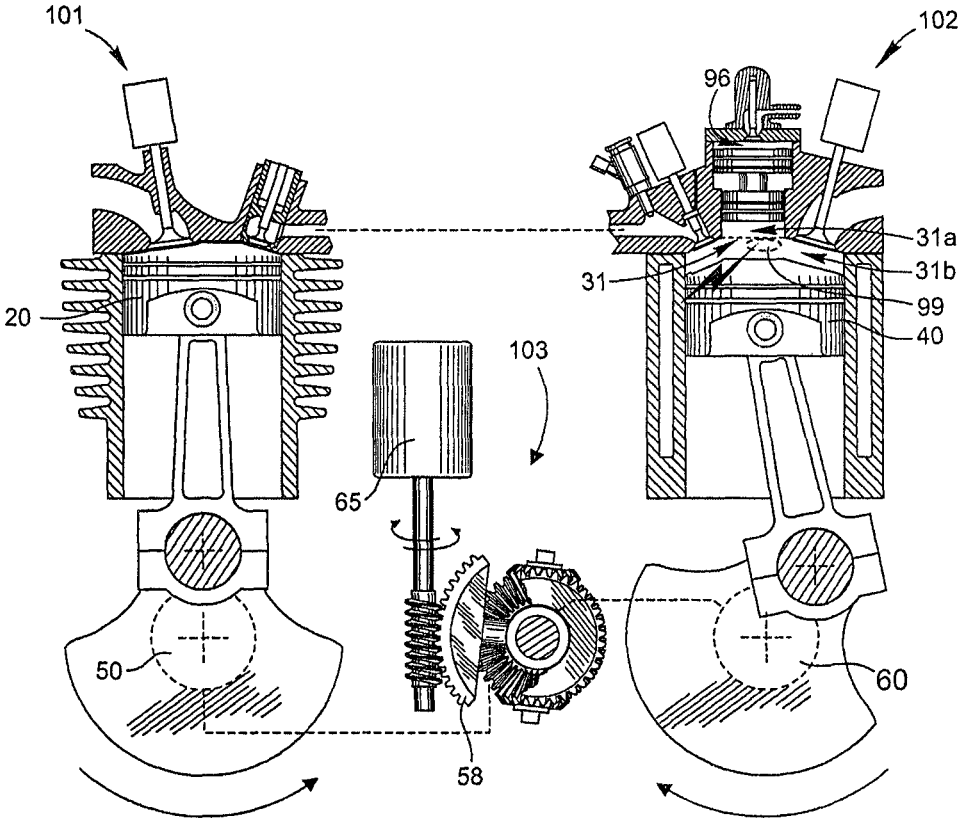
FIG. 6 is a partially dismantled view of the engine schematically illustrates the engine's functionality at heavy load engine operating condition.

With reference to FIG. 6, the motor 65 drives the worm gear 58 by 12.5 degrees clockwise relative to its previous position at low load engine operating condition (see FIG. 5) and thus the crankshaft 50 is retarded by about 25 CAD out of phase to that of the crankshaft 60 from the previous position at low load operating condition. Therefore, the crankshaft 50 is retarded by 35 CAD (25 CAD plus 10 CAD at previous low load condition) than the crankshaft 60. Thus, a condition for full-load engine operation is established. At full-load engine operation, wherein, full amount intake mass is compressed and at the end of a compression stroke, the compression piston 20 reaches to its top dead center (TDC) position whereas, the power piston 40 moved about 35 crank angle degrees (CAD) past TDC position through an expansion stroke. A combustion event is configured to start at or a little before of this position. At the point of ignition, volume of the expansion chamber 31 (including volumes 31*a* and 31*b*) is substantially larger than it is at part load operating condition (see FIG. 5) and thereby, at the point of ignition, nearly constant expansion chamber pressure is maintained throughout the engine operating conditions. At heavy load operating condition of the engine of the present invention, the effective compression and expansion ratio is close to that of the conventional SI engines. Though, various aspects like the working fluid (only air) of compressor unit 101, negligible presence of residual burnt gases in combustion chamber 31 are different from and more favorable than the conventional engines.

The engine of the present invention is capable to produce high turbulence in the combustion chamber with favorable combustion chamber pressure, temperature and mixture density at all the load condition, hence, does not require lean or reach fuelling of working fluid. The split cycle phase variable reciprocating piston spark ignition engine is operable with all type of spark ignitable fuels like gasoline, ethanol, methanol, liquefied petroleum gas, compressed natural gas, various blending of SI fuels etc. Transitions between the uses of different fuels require some modifications in fuel-air ratio, compression ratio, spark timing etc. which may easily be attained by means of provision of a suitable algorithmic program in the electronic control unit 25 to be responsive to said fuel transition events.

The engine of the present invention is configured for unthrottled intake system, hence, is free from pumping loss. Moreover, the split cycle phase variable reciprocating piston spark ignition engine is capable of and most preferably use stoichiometric (chemically correct) fuel-air ratio at all the load conditions, which ensure optimum performance output from a three-way catalytic converter.

As will be understood by those skilled in the applicable arts, various modifications and changes can be made in the invention and its particular form and construction without departing from the spirit and scope thereof. The embodiments disclosed herein are merely exemplary of the various modifications that the invention can take and the preferred practice thereof. It is not, however, desired to confine the invention to the exact construction and features shown and described herein, but it is desired to include all such as are properly within the scope and spirit of the invention disclosed.

The invention claimed is:

1. A split-cycle phase variable reciprocating piston spark ignition engine comprising:

a compressor unit having a compression chamber configured to carry out an intake stroke and a compression stroke of a four stroke engine cycle;

a power unit having an expansion chamber configured to carry out an expansion stroke and an exhaust stroke of the four stroke engine cycle;

an expansion chamber volume modifier configured to modify a volume and a shape of the expansion chamber;

a crossover gas passage configured to transfer compressed gas from the compression chamber of compressor unit to the expansion chamber of the power unit, the expansion chamber is directly connected to the expansion chamber volume modifier;

a phase altering mechanism configured to alter a phase relation between the compressor unit and the power unit; and an electronic controller configured to provide control commands for operating at least one actuator and one motor of the split-cycle phase variable reciprocating piston spark ignition engine.

2. A split-cycle phase variable reciprocating piston spark ignition engine comprising:

a compressor unit including a cylinder, a cylinder head, a piston, and a first crankshaft connected to the piston by a connecting rod;

a power unit including a cylinder, the cylinder head, a piston, and a second crankshaft connected to the piston by a connecting rod;

an expansion chamber volume modifier configured to modify a volume and a shape of an expansion chamber of the power unit, the expansion chamber volume modifier including a cylinder, a free piston movable within the cylinder, a cylinder head including an intake port, an inlet check valve, a gas passage connected to the intake port, a pressure chamber providing an air spring configured to induce continuous pressure on the free piston, and an external pump configured to deliver compressed gas to the pressure chamber via said gas passage;

a crossover gas passage including a one way check valve at one end of the crossover gas passage connecting a compression chamber of the compressor unit, and a crossover delivery valve at another end of the crossover gas passage connecting the expansion chamber of the power unit, the expansion chamber is directly connected to the expansion chamber volume modifier;

a phase altering mechanism including a first bevel gear mounted on the first crankshaft of the compressor unit, a second bevel gear mounted on the second crankshaft of the power unit, an array of bevel gears interconnecting the first bevel gear and the second bevel gear, a spider hub including a plurality of extended arms supporting the array of bevel gears; a worm gear coaxially attached with the spider hub and meshed with a worm, and a motor configured to drive the worm in either of two directions about an axis of the spider hub;

an electronic controller configured to control commands for electrically operated at least one actuator and one motor of the split-cycle phase variable reciprocating piston spark ignition engine.

3. The split-cycle phase variable reciprocating piston spark ignition engine as claimed in claim 2, wherein the cylinder head further comprises:

an intake port including an intake valve, one end of a crossover gas passage including a one way check valve in close proximity of the compression chamber of the compressor unit;

an exhaust port including an exhaust valve, another end of the crossover gas passage including the crossover delivery valve, a spark plug, and the expansion chamber volume modifier in close proximity of the expansion chamber of the power unit; and a fuel injector mounted in close proximity of the gas passage and configured to inject fuel into the crossover gas passage.

4. The split-cycle phase variable reciprocating piston spark ignition engine as claimed in claim 1, wherein the split-cycle phase variable reciprocating piston spark ignition engine further comprises:

a multi-cylinder compressor unit having a plurality of compression cylinders including a first compression cylinder and a second compression cylinder configured to sequentially carry out the intake stroke and the compression stroke of the four stroke engine cycle;

a multi-cylinder power unit having a plurality of expansion cylinders including a first expansion cylinder and a second expansion cylinder configured to sequentially carry out the expansion stroke and the exhaust stroke of the four stroke engine cycle.

5. The split-cycle phase variable reciprocating piston spark ignition engine as claimed in claim 4, wherein the multi-cylinder compressor unit further includes a first crankshaft including a first crank throw and a second crank throw operatively connected to the first compression cylinder and the second compression cylinder respectively; and the multi-cylinder power unit further includes a second crankshaft including a third crank throw and a fourth crank throw operatively connected to the first expansion cylinder and the second expansion cylinder respectively.

6. The split-cycle phase variable reciprocating piston spark ignition engine as claimed in claim 5, wherein the first crankshaft is arranged axially parallel to the second crankshaft, and a first helical gear is coaxially fitted on one end of the first crankshaft, a second helical gear is coaxially fitted with a first bevel gear of the phase altering mechanism, and a second bevel gear of the phase altering mechanism is coaxially fitted on one end of the second crankshaft, and the first bevel gear and the second bevel gear are operatively interconnected by a plurality of bevel gears of the phase altering mechanism.

* * * * *